US008733499B2

(12) United States Patent
Tizzoni

(10) Patent No.: US 8,733,499 B2
(45) Date of Patent: May 27, 2014

(54) SUPPORTING STRUCTURE FOR AN ANTI-NOISE BARRIER WHEREIN FOUNDATIONS AND LIFTING POST ARE REALIZED IN A SINGLE ELEMENT AND RELATIVE ASSEMBLY METHOD

(75) Inventor: Giampaolo Tizzoni, Pontedera (IT)

(73) Assignee: Urbantech S.R.L., Pontedera (PISA) (IT)

( * ) Notice: Subject to any disclaimer, the term of this patent is extended or adjusted under 35 U.S.C. 154(b) by 0 days.

(21) Appl. No.: 13/811,460

(22) PCT Filed: Aug. 6, 2010

(86) PCT No.: PCT/IT2010/000359

§ 371 (c)(1),
(2), (4) Date: Feb. 28, 2013

(87) PCT Pub. No.: WO2012/017460

PCT Pub. Date: Feb. 9, 2012

(65) Prior Publication Data

US 2013/0180799 A1 Jul. 18, 2013

(51) Int. Cl.

| | |
|---|---|
| ***E04B 1/24*** | (2006.01) |
| ***E04C 3/32*** | (2006.01) |
| *E04B 1/18* | (2006.01) |
| *E04C 3/30* | (2006.01) |

(52) U.S. Cl.
USPC ..... 181/285; 52/293.1; 52/842; 248/530

(58) Field of Classification Search
USPC ..... 181/285, 284; 52/144, 145, 293.1, 298, 52/483.1, 838, 842; 248/530
See application file for complete search history.

(56) References Cited

U.S. PATENT DOCUMENTS

| | | | | | |
|---|---|---|---|---|---|
| 903,944 | A | * | 11/1908 | Andersen | 52/156 |
| 1,408,332 | A | * | 2/1922 | Zimmerman | 52/153 |
| 1,774,288 | A | * | 8/1930 | Nickerson | 52/162 |
| 2,664,179 | A | * | 12/1953 | Gwynne | 403/387 |
| 4,156,332 | A | * | 5/1979 | Thompson | 52/165 |
| 4,279,104 | A | * | 7/1981 | Classen | 52/38 |
| 4,325,457 | A | * | 4/1982 | Docherty et al. | 181/210 |
| 4,566,558 | A | * | 1/1986 | Link et al. | 181/210 |
| 4,674,593 | A | * | 6/1987 | McCarty | 181/210 |
| 4,787,601 | A | * | 11/1988 | Rybak | 256/19 |

(Continued)

FOREIGN PATENT DOCUMENTS

| | | | | |
|---|---|---|---|---|
| DE | 2827950 | A1 | 1/1980 | |
| FR | 2560268 | A1 * | 8/1985 | E04H 17/06 |

(Continued)

*Primary Examiner* — Edgardo San Martin
(74) *Attorney, Agent, or Firm* — Lucas & Mercanti, LLP

(57) ABSTRACT

A supporting structure for an anti-noise barrier and relative assembly method are disclosed. The foundation and the structural post of the barrier are a single continuous piece in the shape of a sheet pile. The sheet pile has a first part and a second part of such a length that, in use, the second part is insertable on the ground to realize the foundation, while, contextually, the first part emerges from the ground upwards. The first part of the sheet pile, besides, is provided with connection means through which to be able to connect the sound-absorbent panels, and with a plate on which to lean the panels themselves in such a way that the arrangement on the ground of the foundation and of the structural post is results realizable in a single phase to then proceed with the second phase of application of the panels.

12 Claims, 4 Drawing Sheets

(56) References Cited

U.S. PATENT DOCUMENTS

| | | | | | |
|---|---|---|---|---|---|
| 4,838,524 | A * | 6/1989 | McKeown et al. | 256/24 |
| 4,867,421 | A * | 9/1989 | Vernon | 256/54 |
| 4,893,787 | A * | 1/1990 | Watson | 256/35 |
| 4,928,446 | A * | 5/1990 | Alexander, Sr. | 52/98 |
| 5,058,337 | A * | 10/1991 | O'Connor | 52/162 |
| 5,123,623 | A * | 6/1992 | McNamara | 248/545 |
| 5,272,284 | A * | 12/1993 | Schmanski | 181/210 |
| 5,539,163 | A * | 7/1996 | Anderson et al. | 181/210 |
| 5,592,796 | A * | 1/1997 | Landers | 52/241 |
| 5,709,366 | A * | 1/1998 | Speece | 248/530 |
| 6,123,169 | A * | 9/2000 | Borris et al. | 181/210 |
| 6,397,550 | B1 * | 6/2002 | Walker et al. | 52/653.1 |
| 6,484,460 | B2 * | 11/2002 | VanHaitsma | 52/293.1 |
| 6,793,204 | B2 * | 9/2004 | Albritton | 256/13.1 |
| 7,225,593 | B2 * | 6/2007 | Wilhour | 52/653.1 |
| 7,627,994 | B1 * | 12/2009 | Demirkan | 52/165 |
| 8,307,610 | B2 * | 11/2012 | Landers | 52/846 |
| 2002/0053180 | A1 * | 5/2002 | McGrath et al. | 52/726.2 |
| 2013/0019556 | A1 * | 1/2013 | Zhao | 52/651.01 |

FOREIGN PATENT DOCUMENTS

| | | | | |
|---|---|---|---|---|
| GB | 2218718 | A * | 11/1989 | E04H 17/22 |
| GB | 2312005 | A | 10/1997 | |
| JP | 06180033 | A * | 6/1994 | E04H 2/74 |
| WO | 95/29313 | A1 | 11/1995 | |

* cited by examiner

SUPPORTING STRUCTURE FOR AN ANTI-NOISE BARRIER WHEREIN FOUNDATIONS AND LIFTING POST ARE REALIZED IN A SINGLE ELEMENT AND RELATIVE ASSEMBLY METHOD

CROSS-REFERENCE TO RELATED APPLICATION

This application is a 371 of PCT/IT2010/000359, filed Aug. 6, 2010, the contents of which are incorporated herein by reference,

TECHNICAL FIELD

The present invention refers to the technical field relative to the installation of anti-noise barriers in general.

In particular, the invention concerns a supporting structure for anti-noise barriers which, at the same time, serves as foundation base for the barrier and as supporting structural post for the panels, thus allowing a structural arrangement in loco that is quick and realizable in a single phase.

BACKGROUND ART

Anti-noise barriers have long been commonly known used for circumscribing certain areas or delimiting street and/or train sections in order to protect built-up areas from the noise impact due to the continuous transit of vehicles or trains.

It is known that the barrier is therefore erected on an appropriate supporting foundation along the pre-chosen section of installation.

The background art comprises a first realization phase of the foundation through the insertion on the ground of piles of a length of even up to ten metres. Subsequently, a second completion phase of the foundation involves the realization of a formwork in loco arranged on top of the piles in such a way as to be able to realize a concrete casting for the formation of a thick plinth that leans on such piles. The laying underground depth of the piles is such that the formwork, which leans on them, results to be underground as well so as to find itself substantially at ground level. In accordance with such a realization solution, the heads of the piles therefore result dipped directly in the concrete of the plinth once hardened.

Subsequently, once the complex operation of arrangement of the foundation is completed, a third phase is comprised of connection of the structural posts to the foundation through plates and log bolts. Last, the fourth phase involves the connection of the anti-noise panels to the posts so as to complete the barrier.

Structurally, such a technical solution is not advantageous since it requires four phases of elaboration of which the first two are surely very complex and laborious because they refer to the realization of the foundation. In that sense, it is clear that the background art of realization implies long times of building yard and high costs.

Moreover, both in accordance with the background art described and also in accordance with other eventual alternative techniques, it is always necessary anyway to foresee a phase of connection of the foundation to the supporting structural elements of the barrier, that is the posts to which the panels are connected.

As it is well known, the connection of two elements not only renders always longer and more complex the assembly operation but also increases the production costs since it is necessary to count with an appropriate connection carpentry. It is also clear that the said elements arranged for the connection between two structural elements (in that case foundation and post) further introduce a high structural criticality since they must be dimensioned appropriately. In addition, such connections present criticality as to the alignments and the verticality of the post with respect to the foundation to such point as to need to foresee tolerances to correct eventual maladjustments in the assembly phase.

DISCLOSURE OF INVENTION

It is therefore the aim of the present invention to provide a supporting structure for a barrier in general, particularly an anti-noise barrier, that solves at least in part the above-mentioned technical inconveniences.

In particular, it is the aim of the present invention to provide a supporting structure for a barrier, and the relative assembly method of the same, that is configured in such a way as to be able to perform at the same time the function of foundation and of structural post for the panels so as to significantly simplify the structure as a whole, reduce the production costs and, above all, speed up the installation.

It is also the aim of the present invention to eliminate any joint element in order to guarantee an easier alignment and a precise verticality of the structure, at the same time reducing the realization times and costs and eliminating potential weakening points of the structure that may cause accidental breakings.

These and other aims are therefore obtained with the present supporting structure (1) for an anti-noise barrier (20, 21), preferably a barrier with Porenbeton panels (autoclaved cellular concrete, Autoclaved Aerated Concrete—AAC), as per claim 1.

In accordance with the invention, the foundation and the structural post of the barrier are now realized through a single continuous element in the form of a shaped sheet (2) to vibro-drive, for example the sheet pile (2).

In such a manner, unlike the background art, wherein foundation and posts were constituted by two distinct components connected between them in loco with appropriate carpentry only after the arrangement of the foundation on the ground, it is now possible to operate a simple insertion on the ground of such shaped sheet (2) at the pre-chosen depth, thus allowing to realize in a single phase both the foundation and the structural post to which to connect the panels.

In particular, the said sheet comprises a first part (2') and a second part (2") of such a length that, in use, the second part (2") results insertable on the ground (50) to realize the foundation while, at the same time, the first part (2') will result emerging from the ground upwards and provided with connection means (4, 5) through which to be able to subsequently connect the sound-absorbent panels (6).

In such a manner, the overall assembly of the barrier, generally realized in four phases, is now completed in only two phases, that is sheet pile drive and panel assembly.

Advantageously, it can further be comprised a plate (3) for hardening and for supporting a panel interposed between the first part (2') and the second part (2") and rigidly connected to the sheet pile in such a way that, in use, the said plate (3) can harden the sheet pile in the fixing point on the ground (50). Such plate also serves, during the assembly phase, as support for the panels so that the same can be overlapped one to the other from the ground upwards. Last, the plate realizes a "stop", that is it defines the zero height of barrier start and the penetration depth on the ground.

The plate is therefore welded to the sheet pile so as to form a single element.

Advantageously, the plate comprises a first horizontal surface (3'), substantially orthogonal with respect to the vertical axis (10) of the sheet pile, and a second surface (3"), orthogonal to the said first surface (3'), in such a way that, in use, the said second surface results insertable on the ground (50) in correspondence of the reaching of the end stroke against the ground of the first surface (3'), thus realizing a seal action.

In a possible embodiment, advantageously, the plate (3) is realized in at least two parts rigidly connected to the sheet pile at a predetermined height.

As an alternative, advantageously, the plate can comprise a slot of a shape coinciding with the section of the sheet pile and through which the plate is made to slide along the sheet pile up to the pre-chosen height and rigidly connected to it.

Advantageously, connection means (4, 5) are also comprised that include at least a guide (4) arranged along the first part (2') of the sheet pile (2) and into which one or more fixing brackets (5) are assembled in a sliding manner to which to be able to connect the panels through, for example, screws and bolts.

Advantageously, one or more hardening elements (7) can also be comprised, including at least a beam (7) or a gusset (7) emerging upwards from the plate (3) and welded to the plate (3) or contextually welded to the plate and to the sheet pile.

Advantageously, levelling means (8) can further be comprised configured to verify, during the installation, the orthogonality of the axis (10) of the sheet pile (2) with respect to the ground (50).

Advantageously, for example, in the case of a sheet pile with S section, two guides (4) can be included, each one arranged along a wing of the sheet pile.

It is also described here an anti-noise barrier, preferably a Porenbeton barrier, comprising:

- A foundation (2") on which one or more than one structural posts (2') are erected and;
- One or more than one sound-absorbent panels (6) overlapped and connected to the said structural posts (2');
  - and wherein, further, the foundation and the structural post are a single continuous element in the form of a shaped sheet, preferably a sheet pile (2), comprising a first part (2') and a second part (2") of such a length that, in use, the said second part (2") results insertable on the ground (50) to realize the foundation, while, contextually, the first part (2') results emerging from the ground upwards and is provided with connection means (4, 5) through which the sound-absorbent panels (6) are connected in such a way that the arrangement on the ground of the foundation and of the structural post results realizable in a single phase.

Last, it is described here also a method for the arrangement of an anti-noise barrier along an assembly line and comprising the operations of:

- Insertion on the ground of one or more than one sheet piles (2) as described along the said assembly line, the insertion comprising the operation of sinking of the sheet pile on the ground until the reaching of the end stroke of the hardening plate (3) in such a way that the first part (2') of the sheet pile (2), provided with connection means (4, 5), results emerging out of the ground;
- Connection of the sound-absorbent panels, through the said connection means (4, 5) to the first part (2') of the sheet pile.

BRIEF DESCRIPTION OF DRAWINGS

Further features and advantages of the present invention will result clearer with the description of some embodiments that follows, made to illustrate but not to limit, with reference to the annexed drawings, wherein.

DESCRIPTION OF SOME PREFERRED EMBODIMENTS

Figure 1:
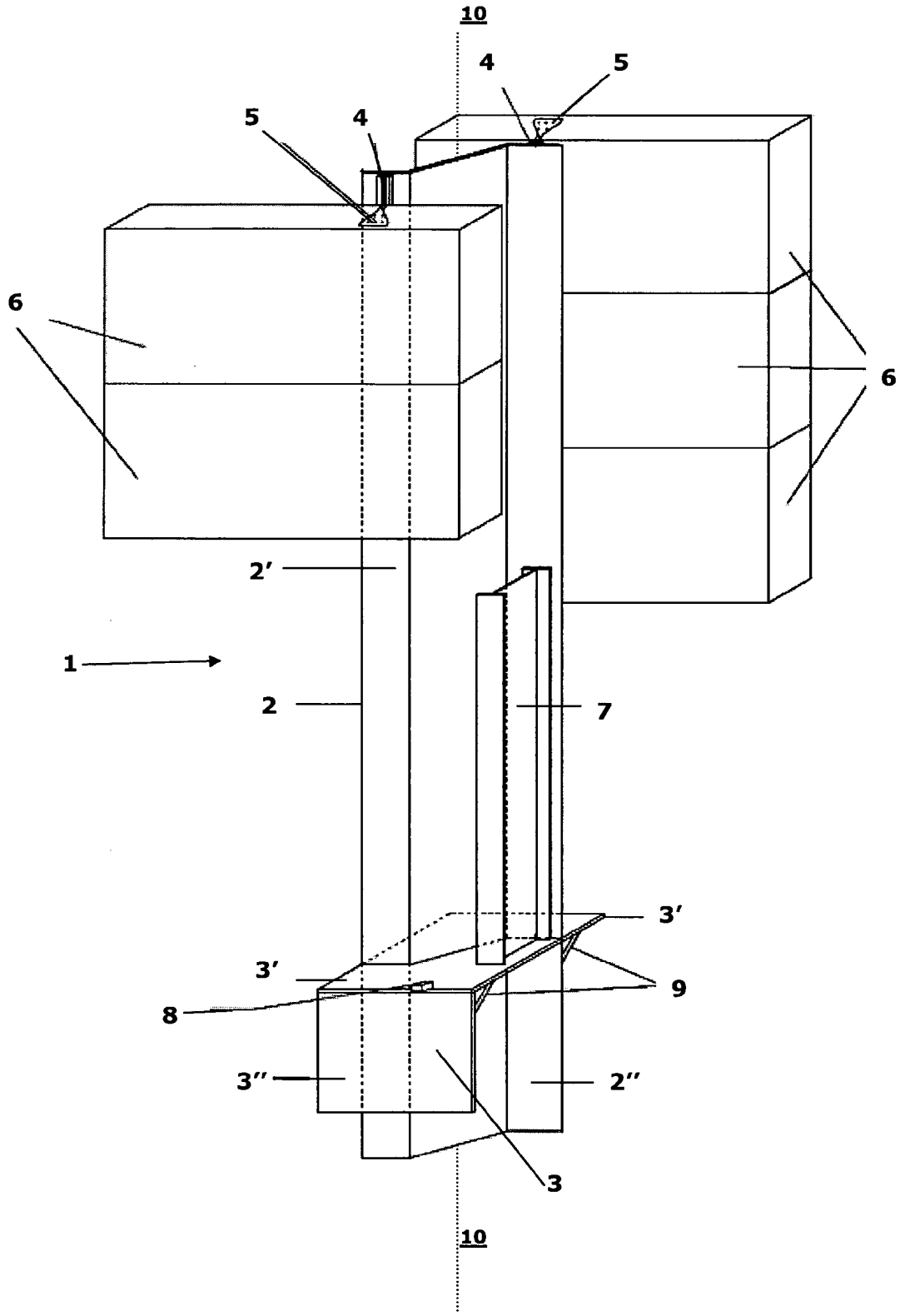
FIG. 1 shows in axonometric view a supporting structure 1 in accordance with the present invention.

With reference to FIG. 1, a supporting structure 1 is described for an anti-noise barrier in accordance with the present invention.

The supporting structure 1 comprises a shaped sheet 2 to vibro-drive on the ground of any section and material. The shaped sheet 2 can therefore be constituted, in accordance with the preferred configuration of the invention, by a simple sheet pile 2 with S section. Nevertheless, it is clear that other types of shaped sheets different from the sheet pile can be used without for this moving apart from the present inventive concept.

Always as shown in FIG. 1, the sheet pile carries integrated to it a plate (3) for hardening and for supporting a panel connected in a stable way to the sheet pile at a predetermined height.

Preferably, the plate is realized substantially L-shaped, in such a way as to comprise a first horizontal surface 3', that is substantially orthogonal to the vertical axis of the sheet pile 10, and a second vertical surface 3" arranged at a right angle with respect to the first surface 3' and therefore parallel to the said axis 10.

Naturally, although the plate 3 described is L-shaped, other shapes can be realized and without for this moving apart from the present inventive concept. In particular, a flat plate could be realized comprising the single part 3' orthogonal to the axis 10.

The sheet pile 2 and the plate 3 thus configured constitute, in accordance with the invention, a single piece pre-assembled in plant before the installation.

To that aim, for example, the plate 3 can be realized in two parts which are subsequently welded on the sheet pile (before the installation) in an opposed manner one to the other and at a pre-chosen height.

A second alternative would be the realization of a metallic casting in such a way as to form a sheet pile in a single piece already provided with such a plate.

Figure 2:
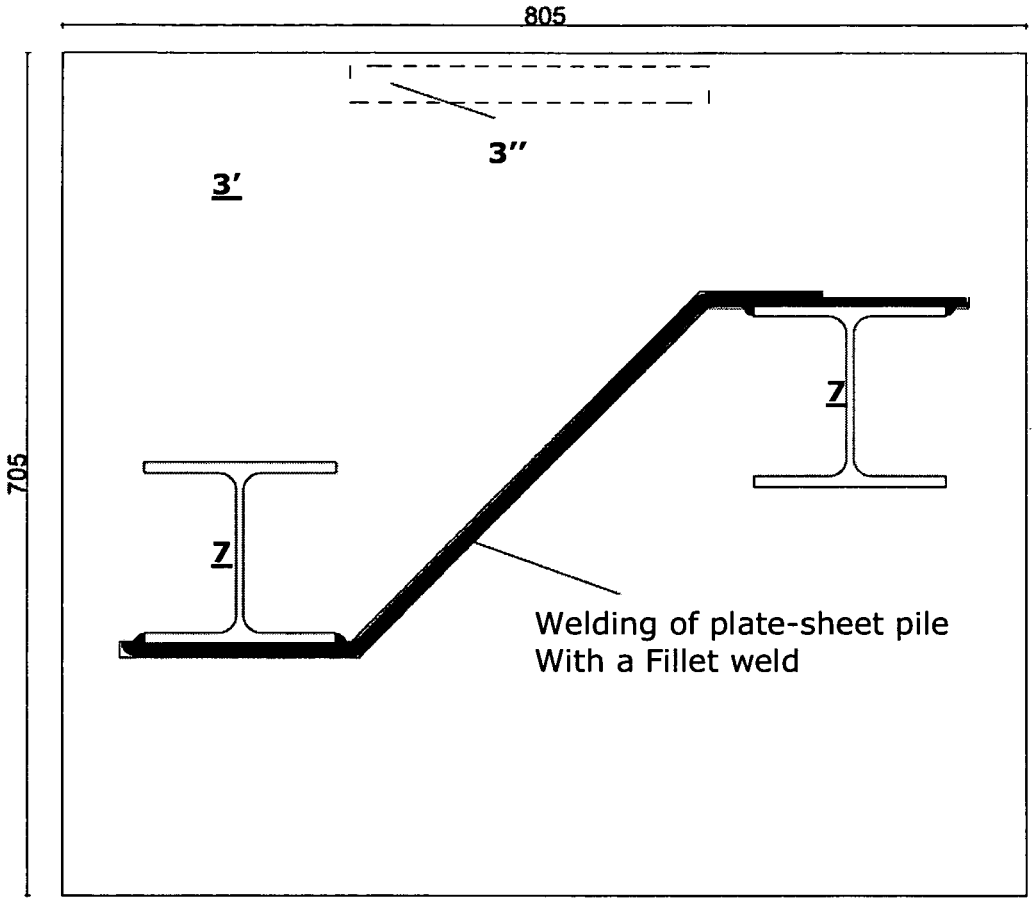
FIG. 2 shows in top view a possible embodiment of the hardening plate provided with a slot into which the sheet pile is coupled by welding to form a single piece.

A third alternative, as shown in FIG. 2, for example, would be the plate 3 realized in a single separated piece but comprising a slot that traces the section of the sheet pile itself. In such a manner, the plate is overlapped to the sheet pile through the slot and made to slide along the length of the same until reaching the desired height. Subsequently, always as shown in FIG. 2, a joint welding can be done, for example along the fillet weld. Always FIG. 2 shows two hardening elements 7 arranged in correspondence of the wings of the sheet pile, which will be described below.

FIG. 2 shows, just for exemplification purposes and therefore not in a limiting manner, some preferred dimensions of plate 3, that is about 80 cm×70 cm.

The plate 3, as shown in FIG. 1, can also comprise in all the cases described hardening arms 9.

In all the cases described, as it was said, the sheet pile and the plate therefore realize a single element pre-assembled in plant before the installation.

The plate 3 theoretically subdivides the sheet piles into two parts, that is a first part 2' that emerges upwards from the first surface 3' in the opposite direction to that of the second vertical surface 3" and a second part 2" arranged from the development part of the second vertical surface 3" of the plate 3.

Always as shown in FIG. 1, the sheet pile comprises appropriate connection means (4, 5) that allow, as better described below, to connect in an overlapped manner one or more than one panels 6 to the sheet pile itself in the first part 2' of the same.

The said connection means therefore comprise two guides 4, preferably of the "Halfen" type, arranged each one respectively on a wing of the sheet pile. The guides 4 hold fixing brackets 5, sliding along the guides in such a way that continuously the panels can be overlapped one to the other, while they are fixed to the sheet pile inserting the bracket 5 into the guide and nailing the bracket 5 at the top of the panel 6.

A further hardening element 7 for the sheet pile, for example metallic gussets or an H-beam 7, is rigidly connected to the horizontal surface 3' of the plate 3 and develops in height in the direction of the first part 2' of the sheet plate. Such element has therefore the function of further hardening in order to limit the deflections of the first part 2' of sheet pile around the plate 3. For this reason, its height is much inferior if compared to the overall length of the sheet pile. The overall length of the sheet pile can in fact be pre-chosen around, for example, the 12 metres, with the second part 2" of a length from 4 to 9 m and the overhanging part 2' of a length of about 5 m or function of the total height of the anti-noise barrier requested. The overall length of the H-beam 7 can therefore be from about 0.5 m to 1.5 m and can eventually be connected by welding. Moreover, the gusset or the beam 7 is welded to both the sheet pile 2-plate 3 elements in order to increase the rigidity around the critical fixing point.

As shown in FIG. 2, for example, two of the said hardening elements 7 are preferably comprised, arranged on two opposed parts of the sheet pile, for example in correspondence of the two wings in case of S sections.

Always FIG. 1 further shows a levelling element 8, for example an electronic sensor or mechanical systems like the plumb line, able to verify the perfect orthogonality of the axis 10 with respect to the ground when the sheet pile is set, as described below.

Having structurally described the basic elements, we will now describe the realization and installation phases.

Figure 4:
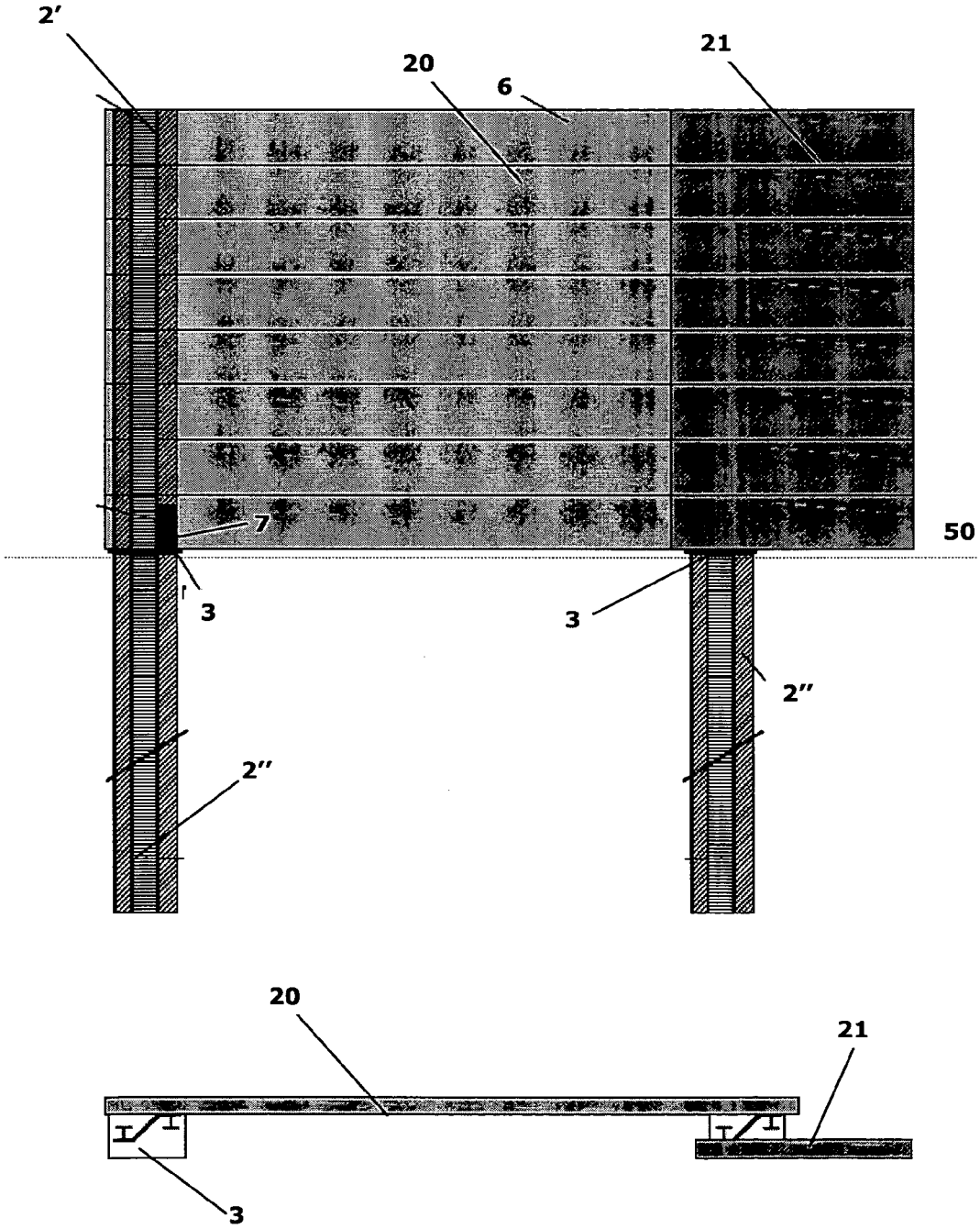
FIG. 4 shows in front and top view a barrier realized through two modules 20 and 21 and comprising a supporting structure 1 in accordance with the invention.

FIG. 4 represents, in a non limiting manner and just for exemplification purposes, a barrier realized by just two modules 20 and 21 arranged in accordance with the present structure 1.

In particular, in a first phase a plurality of supporting structures 1 are arranged along the assembly line as described.

In the said first phase, therefore, the sheet pile is inserted on the ground 50 whose overall length is such that the part 2" destined to be set on the ground reaches a proper depth so as to function as foundation (therefore, a depth of about 7 m, for example), while the part 2' emerging from the ground 50 will have the pre-established height of the barrier that is intended to be built (for example 5 m).

In accordance with the preferred embodiment of the invention, the sheet pile carries integrated to it, forming a single element, the plate (3) for hardening and for supporting a panel arranged at the height that subdivides exactly the part 2" destined to be driven on the ground from that 2' emerging from the ground and to which to connect the panels through the guides 4.

Although not essential for an optimal realization of the invention, such plate 3 is very important since it has four effects. The first one is that of particularly hardening the structure in the point of maximum stress, that is the fixing point of the sheet pile on the ground 50. Moreover, it serves as stop to indicate the height of barrier start and therefore the depth of insertion on the ground, rendering the operation of insertion and assembly quicker and more precise. Moreover, as better described in detail below, it realizes a physical support for the panels. Last, it serves as physical support for all the eventual accessory components that serve, for example, to indicate the perfect orthogonality of insertion of the sheet plate with respect to the ground.

In the particular case of the plate 3 described in FIG. 1, as it was said, it comprises a second surface 3" orthogonal to the surface 3'. The function of such second surface 3" is particularly important as well since it realizes a grasping tooth 3" that is driven on the ground. In such a manner, in the case of sloppy or steep ground, it functions as seal, which contributes to the overall stability of the barrier and thus constitutes a further fixing element on the "mountain" side of the slope.

As already said, therefore, the insertion on the ground of such supporting structures 1 as described (in particular of the sheet pile with eventual plate) allows to realize contextually in a single phase foundation and structural posts, speeding up the installation and eliminating completely the presence of the joints.

At the end of such first phase a part 2' will be directly obtained of the sheet pile emerging upwards from the ground for the remaining height (for example about 5 m) in such a way that on the said part 2' on which the guides 4 are welded the arrangement of the panels can take place.

Figure 3:
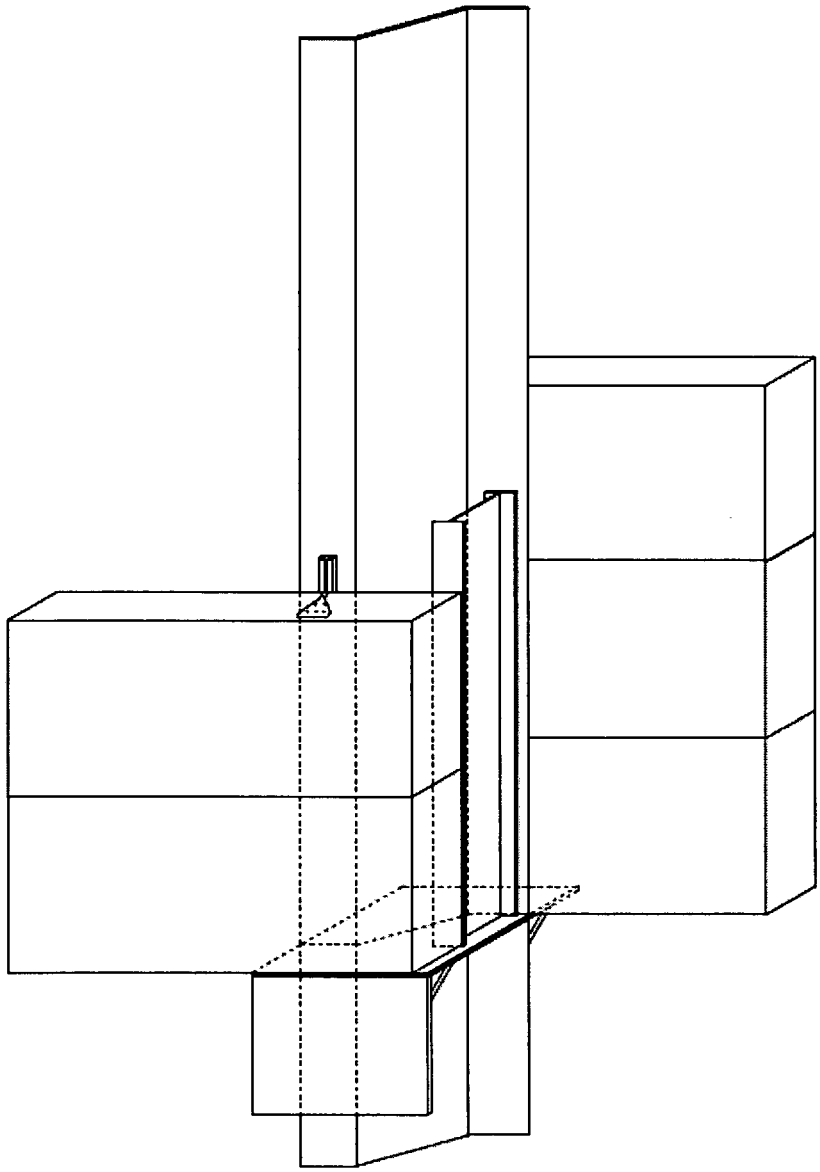
FIG. 3 shows in axonometric view a supporting structure 1 in accordance with the invention wherein the order of overlapping of the panels is highlighted from the plate 3 upwards.

In particular, as better shown in FIG. 3, for the assembly of the panels, the beginning is generally from bottom (that is from the plate 3) on which the first panel leans and connected to the sheet pile through the bracket 5 inserted in the guide 4 and fixed to the panel 6 with appropriate nails-pivots. The bracket 5 can be sliding along the guide in such a way as to facilitate the assembly. In such a manner, a second flask 5 is fixed to a second panel and the flask 5 is made to slide along the guide 4 until the second panel is overlapped to the first in contact. This is done for all the height of the part 2' of the sheet pile emerging from the ground so as to complete the barrier.

Although such invention is preferably addressed to Porenbeton barriers, that is autoclaved cellular concrete (autoclaved aerated concrete—AAC), it is anyway clear that the same lends itself well also to the use of panels of other material and nature such as, for example, wood or concrete or lightened concrete or leca or concrete and wooden, aluminium or iron fibres.

Moreover, the preferred embodiment of the invention describes the use of a sheet pile. The same inventive concept could anyway apply to other equivalent elements sui table for being inserted on the ground, such as a pile having the technical features described.

Last, although it has been described a sheet pile in a single piece of proper length, it is to be understood here that the same sheet pile can also be obtained by welding in plant various pieces of sheet pile among them until reaching, the desired length, realizing anyway a single continuous element or piece arranged for the installation

The invention claimed is:

1. An anti-noise barrier comprising:

at least two supporting structures, each in turn comprising a foundation destined in use to be inserted on the ground, and a structural post erected on said foundation; and a plurality of sound-absorbent panels connected to the posts of said at least two supporting structures, and connection means arranged between said posts and said panels, the barrier, wherein, in each supporting structure, said foundation and said structural post are a continuous piece in the form of a sheet pile extending along a vertical axis, each supporting structure further comprising a plate rigidly connected to said sheet pile, interposed between a first part and a second part of said continuous piece, said first and second parts realizing, respectively, said post and said foundation, said plate comprising a first horizontal plate portion, substantially orthogonal with respect to said vertical axis of the sheet pile and adapted to support the panels, and a second plate portion orthogonal to said first plate portion, thereby said second plate portion is inserted in the ground as the first plate portion is stopped against the same ground.

2. The anti-noise barrier according to claim 1, wherein said connection means comprise at least one guide arranged along said first part of the sheet pile and into which one or more fixing brackets for fixing said panels are slidably engaged.

3. The anti-noise barrier according to claim 2, further comprising at least one beam parallel with said vertical axis, emerging upwards from said plate and welded thereto.

4. The anti-noise barrier according to claim 3, wherein said beam is welded to the sheet pile.

5. The anti-noise barrier according to claim 3, wherein said beam has an H-shaped section.

6. The anti-noise barrier according to claim 2, wherein said sheet pile has an S-shaped section defining two wings, two of said guides being arranged on respective wings of said S-shaped section of said sheet pile.

7. The anti-noise barrier according to claim 3, wherein said sheet pile has an S-shaped section defining two wings, two beams being arranged on respective opposite parts of the sheet pile in correspondence of respective wings.

8. The anti-noise barrier according to claim 3, wherein said at least one beam extends for a height lower than the overall length of the sheet pile.

9. The anti-noise barrier according to claim 8, wherein the length of said at least one beam is comprised between 0.5 m to 1.5 m when the overall length of the sheet pile is about 12 m, said first part having a length of 5 m and said second part having a length of 7 m.

10. A method for the arrangement of an anti-noise barrier according to claim 1, wherein said sheet piles are inserted on the ground sinking said second part until said plate reaches the ground in such a way that the first part results emerging from the ground, so that the arrangement on the ground of the foundation of the post are realized in a single phase, and then the sound-absorbent panels are connected to the first part via said connection means.

11. The method according to claim 10, wherein said plate is preliminarily mounted on said sheet pile by forming in said plate a slot of a shape coinciding with the section of the sheet pile and through which the plate is made to slide along the sheet pile until the pre-chosen position is reached, and then the plate is rigidly connected to the sheet pile.

12. The method according to claim 1, wherein said plate is welded to said sheet pile.

* * * * *